US006149283A

United States Patent [19]

Conway et al.

[11] Patent Number: 6,149,283

[45] Date of Patent: Nov. 21, 2000

[54] LED LAMP WITH REFLECTOR AND MULTICOLOR ADJUSTER

[75] Inventors: Kathryn M. Conway, Nassau, N.Y.; Yutao Zhou, Richmond Heights, Ohio

[73] Assignee: Rensselaer Polytechnic Institute (RPI), Troy, N.Y.

[21] Appl. No.: 09/401,137

[22] Filed: Sep. 22, 1999

Related U.S. Application Data

[60] Provisional application No. 60/111,548, Dec. 9, 1998.

[51] Int. Cl.[7] ..... F21V 1/00

[52] U.S. Cl. ..... 362/236; 362/241; 362/249; 362/439; 362/800

[58] Field of Search ..... 362/231, 236, 362/240, 241, 249, 439, 800

[56] References Cited

U.S. PATENT DOCUMENTS

| | | | |
|---|---|---|---|
| 4,271,408 | 6/1981 | Teshima et al. | 340/702 |
| 4,298,869 | 11/1981 | Okuno | 340/782 |
| 5,388,357 | 2/1995 | Malita . | |
| 5,463,280 | 10/1995 | Johnson . | |
| 5,726,535 | 3/1998 | Yan . | |
| 5,949,347 | 9/1999 | Wu . | |
| 6,016,038 | 1/2000 | Mueller et al. . | |
| 6,026,602 | 2/2000 | Grondal et al. | 40/570 |

*Primary Examiner*—Thomas M. Sember
*Assistant Examiner*—John Anthony Ward
*Attorney, Agent, or Firm*—Notaro & Michalos P.C.

[57] ABSTRACT

A lighting device has a support that can be screwed into a standard 120 volt light socket. A ring with multiple, alternating color, circumferentially spaced LEDs, is connected to the support and a reflector is provided over the ring for reflecting light from the LEDs past the ring. A power supply circuit is connected to the LEDs for powering the LEDs to emit light. The light can be white if the LEDs are a combination of red, blue and green or other white-forming combinations, or the power circuit can selectively power subsets of the LEDs to produce and desired color. The same circuit can be used to vary the intensity of the light in the manner of a dimmer.

19 Claims, 6 Drawing Sheets

LED LAMP WITH REFLECTOR AND MULTICOLOR ADJUSTER

CROSS REFERENCE TO RELATED APPLICATION

The applicants claim the priority benefits of U.S. provisional application 60/111,548, filed Dec. 9,1998, which is incorporated here by reference.

FIELD AND BACKGROUND OF THE INVENTION

The present invention relates in general to lighting, and in particular to a new and useful lamp which utilizes LEDs in a unique combination to produce either white light or any variation in color or intensity of light desired, preferably in the form of a lamp which can be screwed into a standard 120 volt, 60 cycle light socket which is conventional in the United States and elsewhere.

LEDs have many exciting and practical characteristics that make them very attractive for new applications and for use in many types of luminaires; however, there are some technical limitations such as narrow band spectra, extremely directional light distribution, and reliability concerns. Despite their limitations, the use of LEDs is increasing rapidly, and manufacturers are working to introduce new LED products that will address some of the technical problems.

A company known as Color Kinetics Incorporated markets an LED lamp fixture under their CHROMACORE and ICOLOR trademarks.

The CHROMACORE fixture uses direct current at low voltage (24 v) rather than alternating current at normal house voltage (120 v). The CHROMACORE fixture also needs an external AC-to-DC converter and transformer and uses logic control to control the color emitted from the lamp, which requires an external data input device such as a computer.

The CHROMACORE fixture also has the colors of the LED sources mixed after the light is emitted from the lamp, which means that color-mixing effects may not be as uniform when viewed at short distance.

The present invention mixes colors inside the lamp so that the resultant color is uniform when viewed at any distance from the lamp and has other advantageous differences over the Color Kinetics product and over other known lighting devices.

SUMMARY OF THE INVENTION

The present invention is a new electric light source or lamp device with a self-contained mechanism for color and luminance control. The invention uses at least two but preferably three colors of LEDs to create either white light or light of any color, and to create such white or color light in a continuously dimmable manner. The lamp of the invention has a reflector and is meant to be viewed directly as a signal, display, luminaire or decorative object or it can also be used to illuminate a surface, object or other visible medium. The LEDs are arranged in a unique ring.

Accordingly, an object of the present invention is to provide a lighting device comprising a support, a ring of LEDs connected to the support, a reflector connected to the support and positioned for reflecting light from the LEDs in the ring, past the ring and a power supply circuit connected to the LEDs for powering the LEDs to emit light.

A further object of the present invention is to circumferentially space alternating colors of LEDs which are selected so that they are capable of producing white light, around the ring, and providing means in the power supply circuit for powering subsets of the LEDs to create white light or any desired color of light.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
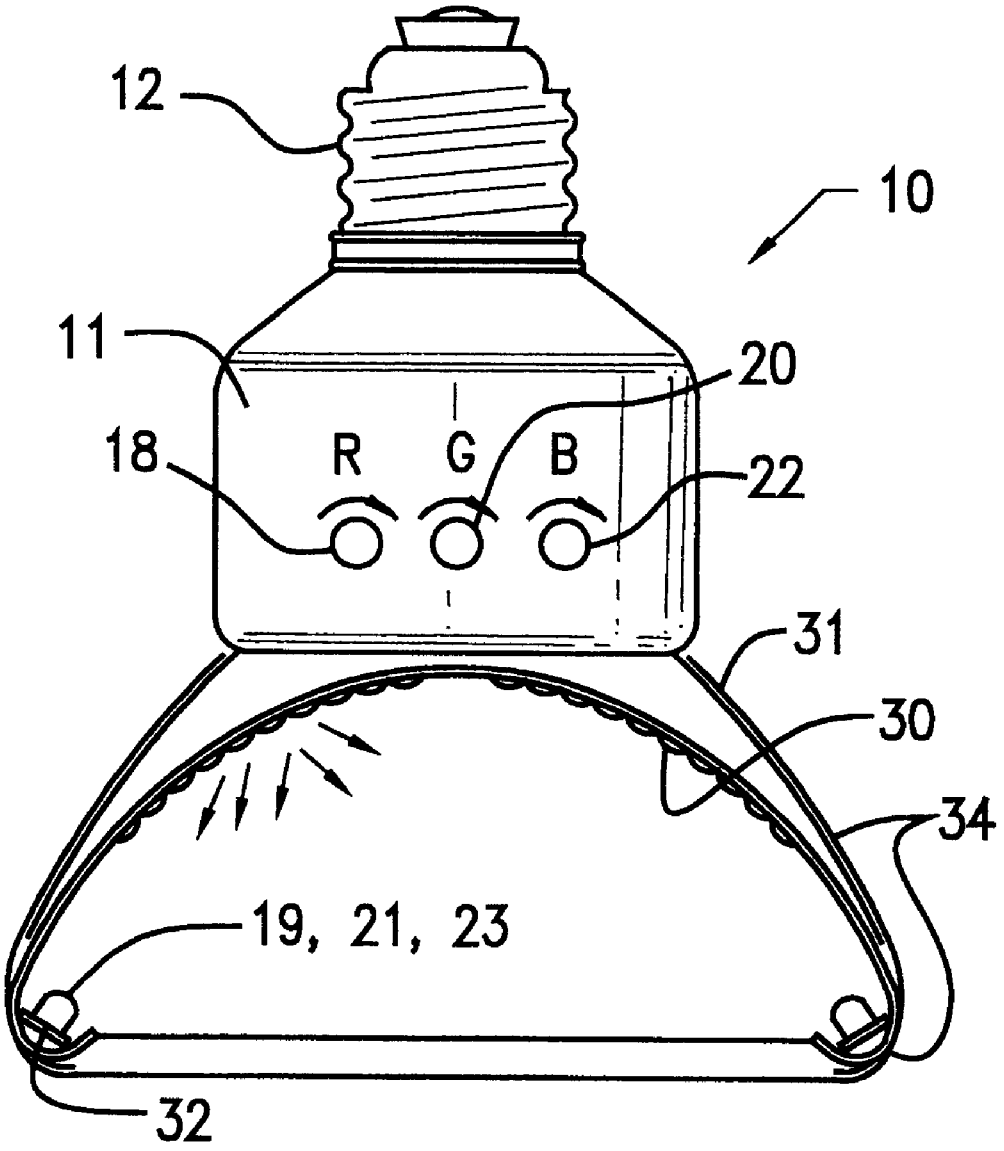
FIG. 1 is a side elevational view, partly in section, of a typical lighting device in accordance with the present invention.
Figure 2:
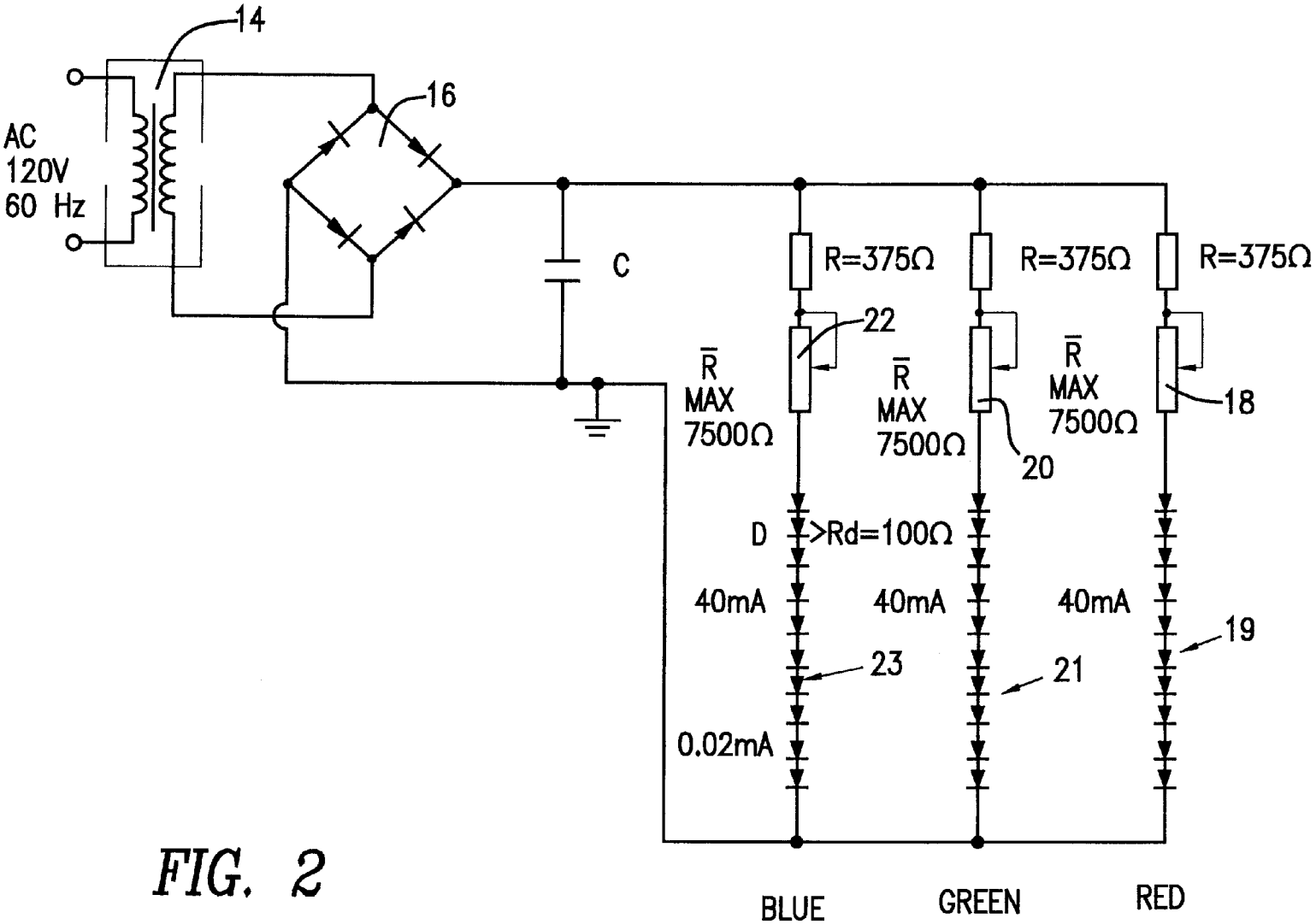
FIG. 2 is a schematic circuit diagram of the present invention.
Figure 4:
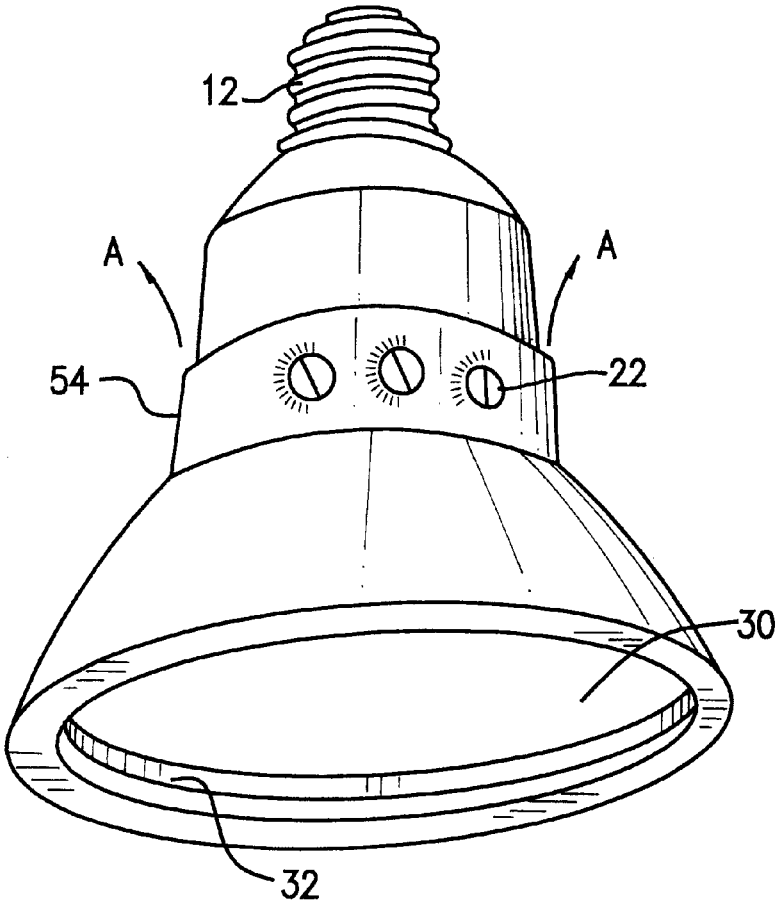
FIG. 4 is a perspective view of another embodiment of the invention.

As illustrated in FIGS. 1 and 2, a device or product 10 made in accordance with the present invention comprises support 11 with socket means such as a screwbase 12, a paired electrical transformer 14 in FIG. 2 and bridge 16 to generate low-voltage direct current, a set of three color adjusters 18, 20, 22 to independently adjust the light output of the three different color LEDs or LED sets 19, 21, 23, a concave reflector 30 with a metallic and textured that is pebbled or peened surface, a ring or channel 32 for holding the LEDs and a heat sink 34 attached to the ring of LEDs to absorb and radiate the heat emitted by the LEDs and to thus permit optimal light output in any given ambient temperature. The three different color LEDs or LED sets 19, 21, 23 may be either chip-on-circuit-board LEDs, or LED packages encapsulated in various molded-epoxy shapes to produce specific beam distribution patterns and mounted or heat-soldered onto the electronic board 32 with a formed, soldered, sandwiched or otherwise attached metallic heat sink 34. The reflector 30 which is between the support 11 and the channel 32 as shown in FIG. 1 has two functions; it reflects the light out of the lamp in a uniform beam and by means of spread reflection from the pebbled or peened surface, it uniformly mixes the light from the various monochromatic LEDs to create white or color light and to eliminate striations of other colors. As also shown in FIGS. 1 and 4, the LEDs are concealed in channel 32 from direct view and emit their light toward the support and screw base 11, 12.

Presently available LED light sources for emitting white light use so-called "white light" LEDs. These white light LEDs are actually blue or UV sources that contain phosphors. Direct observation of these white light LEDs in the inventors' laboratory has shown that a surface illuminated by these white light LEDs appears very unevenly illuminated, and appears to have striations or rings of blue and yellow light. These LEDs also have much lower luminous efficiency than do state-of-the-art monochromatic LEDs.

The invention uses color LEDs as the light source, and mixes different colors to create white light (or any color that is desired or required) with a uniform distribution. The color of the output light can be easily customized and changed by using the color adjusters 18, 20 and 22.

Alternatively, the user can maintain white light at any level of light output because the color adjusters are pre-calibrated for this purpose. The location of the LEDs and the heat sink at the open end of the lamp helps to maintain the LED operating temperature close to ambient conditions, which ensures constant light output, even if the lamp is used in a recessed fixture. Other commonly available reflectorized light sources such as incandescent or fluorescent, have the problem of overheating and giving off lower light output because their electrical components are located near the screwbase, in the narrow, confined and still-air end of the device.

The present invention can be screwed into any standard Edison-screwbase socket supplied with alternating current and therefore the invention can be used conveniently and broadly, without a special direct current power supply or any other accessory equipment or controls. With the rapid developments in LED technology, it is expected that higher luminous efficacy of LEDs will be achieved, and thus that eventually, perhaps within three to five years, the efficacy of the inventive lamp may compete with some incandescent light sources, and could probably replace some incandescent lamps. Such an advance would provide energy efficiency and environmental benefits in addition to its attractiveness as a convenient, dimmable, multicolor or white light source.

The light source of the invention has variable color at variable light outputs, constant "white" light at variable light outputs, cool temperature operation and very long life (life of LEDs may be as long as 100,000 hours; comparable incandescent sources have rated lamp life of 750–3500 hours, comparable fluorescent sources have rated lamp life of 6000–12000 hours). The light source, its electronics and controls are combined in one convenient device and input power demand of only 1.5 watts to 2.0 watts for normal operation is needed.

This invention may be used as the light source for a task light, or for illuminating nearby objects, especially where cool operation is a requirement, such as in food displays or displays of temperature-sensitive solids (for example, museum displays of wax figures). In fact, this light source will perform better (be brighter) as temperature decreases, which is entirely opposite to the performance of incandescent and fluorescent lamps. Thus, it is suitable for outdoor applications in very cold climates, or for cold-storage/display applications.

The invention may have many decorative variations that make it appealing for retail and residential applications. In retail application, it would have a special appeal because it is long-lasting, but offers an infinitely "tunable" array of colors that could be coordinated with the style objectives of the lighting designer. A simple modification to the circuit can allow remote control of color choice and light output. In residences (including hotels, dormitories, multifamily dwellings or single-family dwellings), the invention can be used indoors as a wall sconce, as a "bare lamp," as a desk or table lamp, or night light; or, it could be used outdoors as a porch light, a post-top light, or self-illuminated street address light. The lamps' low-temperature/high light output feature makes it especially useful for cold-climate, night time operation.

The low input power demand and long life of the lamp makes it a good potential match for photovoltaic systems, because the circuit could be modified for direct current operation. PV systems are being promoted in the market for applications where off-grid technologies are more economical than extending the grid to a remote or transient location or activity. Lighting is almost always required for such situations. Emergency situations require localized, self-powered lighting systems, too.

Depending on future LED development, the reflector may be changed to one with a specular finish and with a correspondingly appropriate optical shape, so that the lamp can form a concentrated light beam with high intensity. Then it could be used as a downlight, an accent light, or perhaps even as a vehicular headlight.

Although the lumen output of LEDs are not as high as an incandescent light source of identical wattage, LEDs with higher luminous efficacy will be available in the future. The luminous efficacy of the individual color LEDs (red in particular) however, exceeds that of incandescent lamps that are filtered to produce a monochromatic light. Despite the possible enhanced performance of the present invention based on future LED development, the present invention is fully functional and practical today with current LED technology, allowing those skilled in this art to make and use the invention without experimentation.

The present invention, by way of arranging the LEDs, brings the user physiological and esthetic benefits. The LEDs are arranged on the concealed ring attached to the reflector, so that the user cannot see the light source directly. This eliminates glare and makes the user feel comfortable. The versatility of color is also a clear esthetic advantage over other light sources. Although use of the term ring most commonly refers to a closed circle, the ring may also be a non-circular shape and may be open (for example arc-shaped) or even, in an extreme case, straight. The straight line of LEDs would be used in conjunction with a straight reflector that is curved to one side and enclosed in some form of housing, having an opened bottom with an edge along which the line of LEDs lies. The preferred form of the invention, however, is with the LEDs in a curved ring which is closed and with the reflector above the ring. Further, although the LEDs of the different colors are most commonly placed in alternating positions around the ring, this includes the possibility of multiple LEDs of the same color being positioned next to each other, followed by multiple LEDs of the next color, followed in turn by multiple LEDs of a further color. Here again, although three colors is preferred for completely versatile color mixing and the generation of white light, two LEDs of different colors can also be utilized to produce the two colors as well as a full spectrum of mixtures between the colors depending on the intensity of the light coming from each LED.

Returning to FIG. 2, the transformer 14 is of conventional type for stepping the 120 volts from household current down to a level which is then rectified in bridge 16 and smoothed by capacitor C before it is supplied in parallel across three sets of resistors R, potentiometers as controllers 18, 20 or 22, and the series connected LED sets 19 (red), 21 (green) and 23 (blue). The red, green and blue LEDs alternate around the ring 32 and are individually powered either with all equal power to produce white light or with power which is biased toward one color or the other to produce red, green or blue light, or to separate subsets of the LEDs, for example red and blue to produce purple. In short, any combination of hues can be produced either by manually operating the potentiometers or controls 18, 20 and 22, or by providing suitable circuits to automate their operation. These controls can also be used to dim the light by reducing the power supply to all subsets of LEDs or vary the color of the light or both, vary the color of the light and dim or intensify the light in any desired manner.

Figure 7:
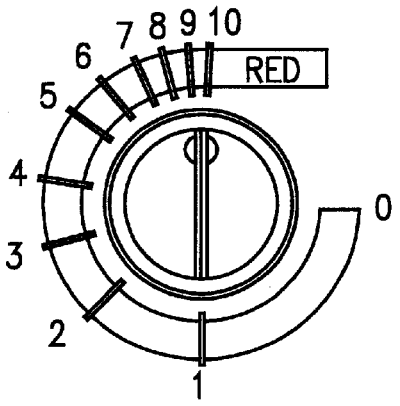
FIG. 7 is an enlarged view of an adjustment mechanism for use with the present invention.

Advantageously, each control may be in the form of a set screw shown for example in FIG. 7, which is set once for a desired intensity or color combination and then left that way throughout the life of the product or throughout a use period for the product. When the intensity or the color is to be changed, a screwdriver can be used to change the screw settings in a way that is convenient but, yet, will not lose its setting in an easy manner.

Figure 6:
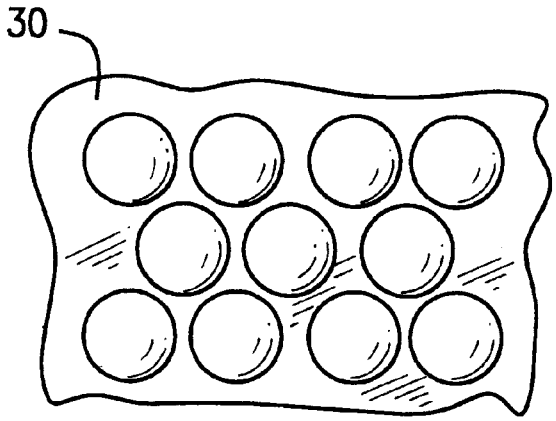
FIG. 6 is a view showing a typical surface pattern for one embodiment of the reflector of the present invention.

FIG. 6 shows the pebble pattern for a typical reflector 30 of the present invention for reflecting and for mixing the light.

Returning to FIG. 1, the support or main frame 11 of the device 1 0, is connected to the socket 12 and also contains the circuitry of FIG. 2. At its surface, access to the controls 18, 20 and 22 are provided. An outer housing or cover 31 extends downwardly from around the lower perimeter of the cylindrical support 11. Housing 31 covers reflector 30 and extends down around, and in fact, its lower edge can be bent up to form the channel and ring 32 for receiving the circumferentially spaced LEDs 19, 21 and 23. As shown by reference numeral 34, housing 31 can also form part of the heat sink for shedding heat from the LEDs.

Figure 3:
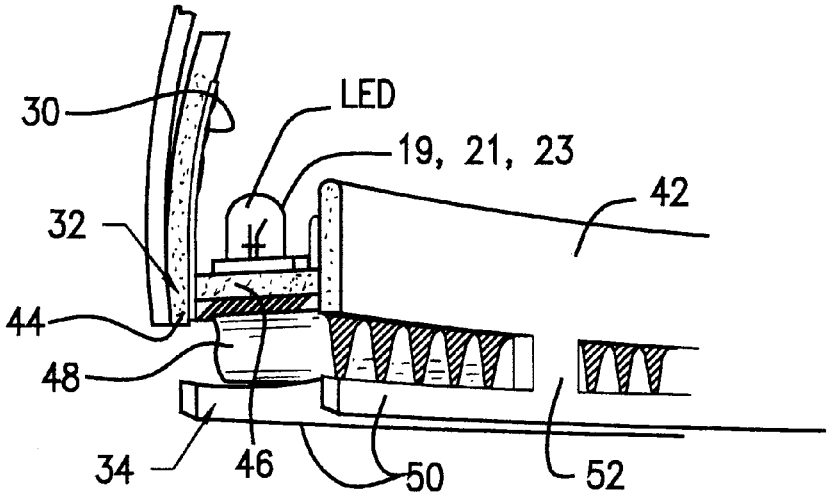
FIG. 3 is an enlarged partial perspective view of the ring and heat sink area of the present invention.

FIG. 3 shows an example of the heat sink 34 in greater detail. An inner ring 42 is spaced circumferentially inwardly from a lower edge 44 of reflector 30 and is bridged by a washer 46 which also acts a platform for the LEDs. A corrugated metal, for example aluminum, structure 48 is in heat contact with support washer or ring 46 and sheds heat. Since air can move among the corrugations of structure 48, heat shedding is improved. A lower pair of heat sink rings 50 support the bottom of the corrugations 48 and are connected by circumferentially spaced solid spacers 52 to the inner ring 42 and the lower edge of the reflector 44 to form air flow slots to the structure 48.

FIG. 4 is a better indication of the outward appearance of the invention of FIG. 3. The invention appears to be a spotlight or floodlight and can conveniently be screwed by socket 12 into any conventional 120 volt light socket.

FIG. 4 also illustrates another embodiment of the invention where a lower portion of the support shown at 54 is ring shaped and is spaced outwardly from an upper portion of the support to produce an annular space which permits airflow A upwardly from the inner surface of reflector 30 past the support and into the ambient for improving the shedding of heat from the LEDs.

Figure 5:
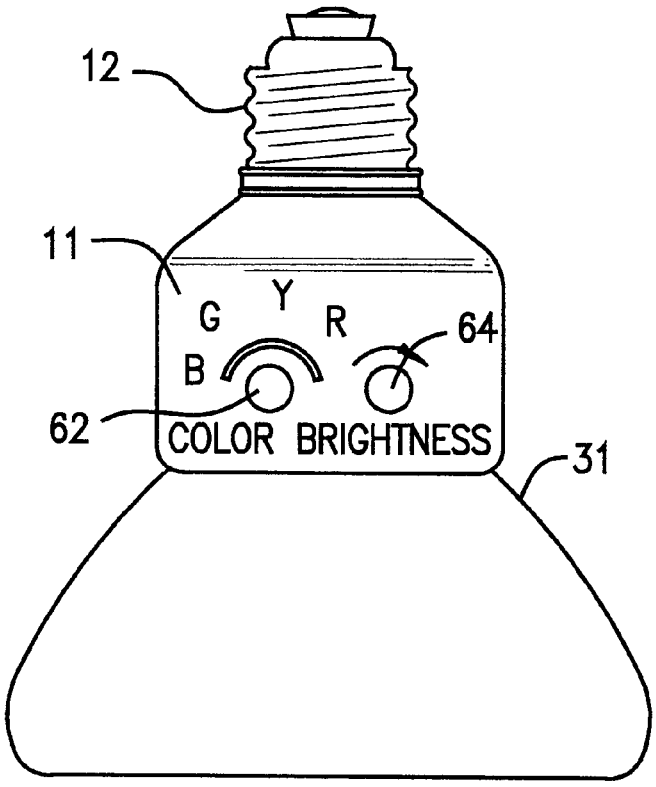
FIG. 5 is a side elevational view of a still further embodiment of the invention.

FIG. 5 illustrates another embodiment of the invention which uses separate dials 62 and 64 for setting color and brightness respectively. Simple re-wiring of the circuit of FIG. 2, which is within the skill of the artisan in this field can achieve this different control mechanism.

Figure 8:
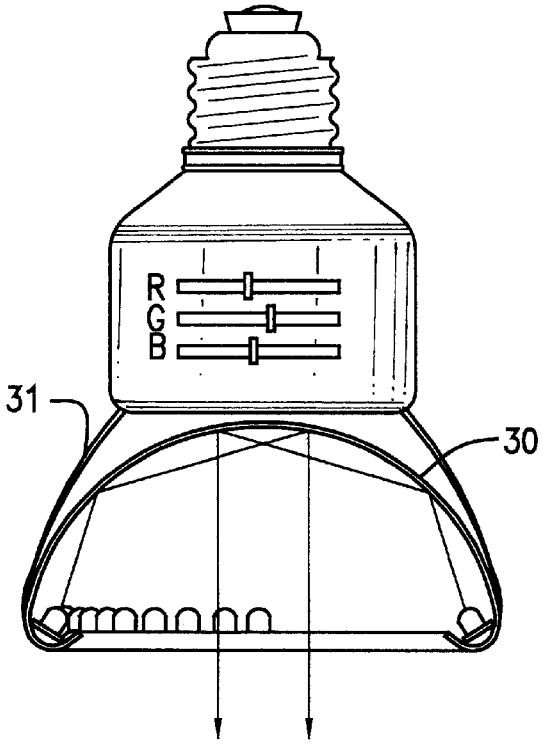
FIG. 8 is a side elevational view, partly in section, of another embodiment of the invention.

FIG. 8 illustrates a still further embodiment of the invention where slides rather than dials are used to set the different LED color intensities and where the outer housing 31 is opaque. FIG. 8 also illustrates how light from the LED ring is reflected. The shape of the reflector 30 is curved in at least one plane passing through the support and channel as shown in FIG. 8 and can be selected to be parabolic to produce a spotlight effect or can be varied to any desired shape to produce different distributions of light, from a floodlight effect to a spotlight effect using known reflection technology. The fact that the ring of LEDs is near the perimeter of the reflector also improves the control of the light reflection available in accordance with the present invention.

Figure 9:
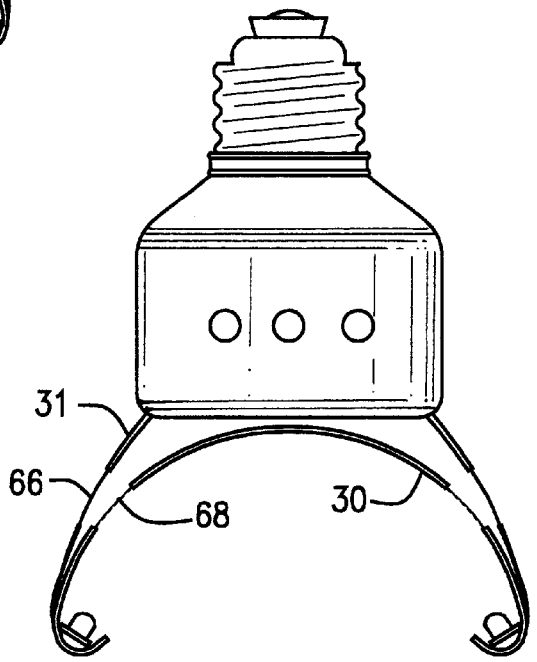
FIG. 9 is a view similar to FIG. 8 of a still further embodiment of the invention.

FIG. 9 illustrates another embodiment of the invention where the outer housing 31 has a central annular translucent material section 66 which is spaced outwardly of a perforated section 68 of the reflector 30. This produces an effect where some of the light from the LEDs is emitted out through the side of the device for producing side lighting and a different decorative effect. Any combination of perforated, non-perforated, translucent, transparent or opaque reflectors and housings, is possible in accordance with the present invention.

Figure 10:
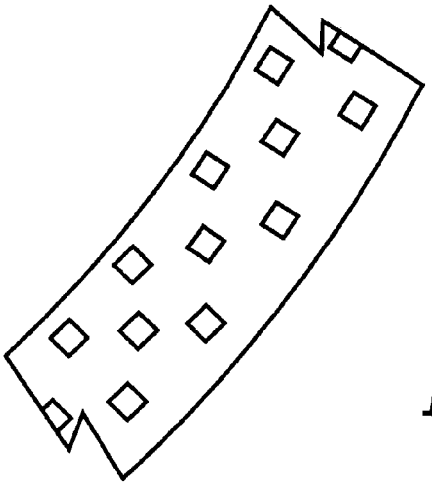
FIG. 10 is a partial view showing an example of the array of LEDs provided in the row or ring of LEDs in accordance with the present invention.

FIG. 10 illustrates how an example of a ring or row of LEDs in accordance with the present invention can include staggered LEDs in an array of LEDs.

Figure 11:
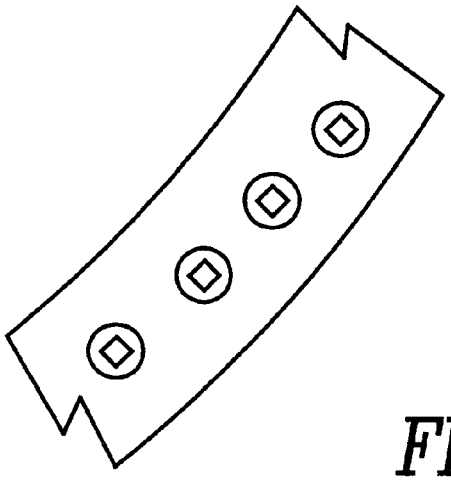
FIG. 11 is a view similar to FIG. 10 of another array.
Figure 12:
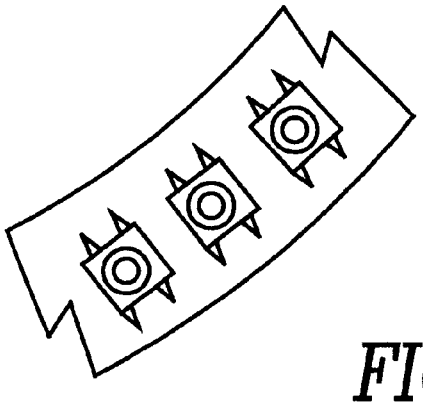
FIG. 12 is a view similar to FIG. 10 of a still further array.

FIG. 11 illustrates another embodiment of the invention where each LED is mounted in its own mounting and FIG. 12 shows a further example where each LED has a more elaborate mounting arrangement, depending on the type and manufacturer of the LED.

While a specific embodiment of the invention has been shown and described in detail to illustrate the application of the principles of the invention, it will be understood that the invention may be embodied otherwise without departing from such principles.

What is claimed is:

1. A lighting device comprising:

a support with socket means for providing electrical power to the device;

a channel which is open toward the support;

a row of LEDs connected to the support, the row of LEDs comprising LEDs of at least two different colors, the LEDs being spaced from each other and recessed in and along the channel so that the LEDs are concealed from direct view in the channel and emit light toward the support;

a reflector connected between the support and the channel and positioned for reflecting light from the LEDs in the row, the reflector having a textured surface and being curved in at least one plane which extends between the channel and the support so that light from the LEDs is mixed by the reflector and reflected past the row and out of the device; and a power supply circuit connected between the LEDs and the socket means for powering the LEDs to emit light.

2. A device according to claim 1, wherein the row of LEDs comprises a ring of a plurality of LEDs in a white-producing color combination.

3. A device according to claim 2, wherein at least some of the LEDs are red.

4. A device according to claim 2, wherein at least some of the LEDs are green.

5. A device according to claim 2, wherein at least some of the LEDs are blue.

6. A device according to claim 2, wherein the power supply circuit includes means for separately manually adjusting a subset of said LEDs, each subset containing LEDs of only one color.

7. A device according to claim 1, including wherein the socket means comprises a screwbase connected to the support for screwing the device into a power socket.

8. A device according to claim 7, wherein the support comprises a cylindrical section between the screwbase and the reflector for containing the power circuit, the row being a ring of LEDs.

9. A device according to claim 8, including a housing around the reflector between the ring of LEDs and the support.

10. A device according to claim 1, including a housing connected between the support and the row of LEDs, the housing being around the reflector.

11. A device according to claim 10, wherein the housing is opaque.

12. A device according to claim 10, wherein the housing is at least partly translucent.

13. A device according to claim 1, wherein the power supply circuit comprises a transformer for stepping power voltage down to a voltage that can be used by the LEDs, a bridge connected to the transformer and a plurality of adjustable LED circuits each containing a subset of LEDs, each subset having a different color.

14. A device according to claim 13, including an adjustor connected to each subset of LEDs for separately manually adjusting an amount of power supplied to each subset of LEDs.

15. A device according to claim 1, including heat sink means connected to the row of LEDs for dissipating heat from the LEDs.

16. A device according to claim 15, wherein the row is a ring, said heat sink means comprises metal corrugations in heat transfer contact with the ring of LEDs.

17. A device according to claim 1, wherein and, the LEDs comprises a plurality of subsets of LEDs each having a different color.

18. A device according to claim 17, including an adjustor in the power supply circuit is separate for each subset of LEDs.

19. A device according to claim 18, wherein said adjustor is a manually operable potentiometer.

* * * * *